US008264316B2

(12) United States Patent
Miura et al.

(10) Patent No.: US 8,264,316 B2
(45) Date of Patent: Sep. 11, 2012

(54) COIL COMPONENT AND METHOD FOR MANUFACTURING COIL COMPONENT

(75) Inventors: Fuyuki Miura, Tokyo (JP); Daiki Amano, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/106,296

(22) Filed: May 12, 2011

(65) Prior Publication Data

US 2011/0279211 A1 Nov. 17, 2011

(30) Foreign Application Priority Data

May 17, 2010 (JP) ..... P2010-113184
May 17, 2010 (JP) ..... P2010-113187

(51) Int. Cl.
*H01F 27/29* (2006.01)

(52) U.S. Cl. ..... 336/192

(58) Field of Classification Search ..... 336/65, 336/83, 192, 196, 198, 200
See application file for complete search history.

(56) References Cited

U.S. PATENT DOCUMENTS 6,788,181 B2 * 9/2004 Yeh et al. ..... 336/192
6,960,976 B2 * 11/2005 Fan ..... 336/83
7,463,130 B2 * 12/2008 Oki ..... 336/192
7,884,693 B2 * 2/2011 Engler et al. ..... 336/192
8,188,824 B2 * 5/2012 Yan et al. ..... 336/192

FOREIGN PATENT DOCUMENTS

JP A-05-182854 7/1993
JP A-2006-228825 8/2006

* cited by examiner

*Primary Examiner* — Tuyen Nguyen

(74) *Attorney, Agent, or Firm* — Oliff & Berridge, PLC

(57) ABSTRACT

To provide a coil component that can adequately ensure component accuracy even when miniaturization is pursued. A coil component includes a main body portion structured with green compact containing magnetic material, a coil arranged inside the main body portion, a pair of lead wires each drawn out from the coil to outside of the main body portion, terminal fittings electrically connected to the lead wires at the outside of the main body portion, and welding portions connecting the lead wires and the terminal fittings. The pair of lead wires is both drawn out towards a first direction that is orthogonal to an axis direction of the coil. Drawing surfaces of the main body portion are disposed towards the coil side from a first side surface that is an end of the main body portion in the first direction. The drawing surfaces perpendicularly intersect the lead wires.

15 Claims, 10 Drawing Sheets

(a)

(b)

(c)

(d)

(a)

(b)

COIL COMPONENT AND METHOD FOR MANUFACTURING COIL COMPONENT

BACKGROUND OF THE INVENTION

1. Field of the Invention

The present invention relates to a coil component and a method for manufacturing a coil component.

2. Related Background Art

As an example of conventional coil components, a coil component that has a main body portion structured with green compact containing magnetic material and arranged with a coil inside and a pair of lead wires drawn out is known (for example, Japanese Patent Application Laid-Open Publication No. 2006-228825). The coil component is constructed by integral molding of the coil and the green compact. The pair of lead wires is drawn out towards outside of the main body portion of the coil component. In the coil component, the pair of lead wires is drawn out such that the lead wires come to 180 degrees apart from each other centering on an axis direction of the coil. Because each of the lead wires is 180 degrees apart from the other, a bent portion is formed between a wire winding portion constituting the coil and each lead wire (for example, see FIG. 9A).

As an example of conventional methods of manufacturing a coil component, a method that electrically connects a terminal fitting and a lead wire of a coil winding is known (for example, Japanese Patent Application Laid-Open Publication No. H5-182854). The terminal fitting in the conventional manufacturing method includes a terminal portion fixed to a main body portion and a bent piece that is bent to form an acute angle with respect to the terminal portion. The terminal fitting has a brazing material layer on the surfaces of the terminal portion and the bent piece. In the manufacturing method, when connecting the terminal fitting and the lead wire, the lead wire is arranged between the terminal portion and the bent piece by winding the lead wire around the terminal portion, and the bent piece is bent. Thereafter, the terminal fitting is irradiated with a laser light beam to fuse the brazing material layer. Consequently, the terminal fitting and the lead wire are electrically connected.

SUMMARY OF THE INVENTION

However, the conventional coil component is structured with the pair of lead wires drawn out in directions different from each other, and requires forming of the lead wires to be bent. Therefore, there have been cases in which it is difficult to ensure the positional accuracy of the lead wire. Particularly, the miniaturization of coil components is in demand in recent years, and thus it is required to adequately ensure the positional accuracy of the lead wire. Furthermore, when the diameter of the lead wire becomes smaller with the miniaturization, it becomes difficult to maintain the lead wire in a bent shape. It is also required to reliably perform the welding between the lead wire and the terminal fitting.

The present invention has been made to solve those issues, and aims to provide a coil component that can sufficiently ensure the component accuracy even when miniaturization is pursued.

In a conventional method for manufacturing a coil component, a step of winding the lead wire to the terminal fitting and a step of bending the bent piece are required, and thus an improvement is needed in terms of workability. Meanwhile, if the fixation between the lead wire and the terminal fitting is not sufficient when performing the welding work, a problem in the connectivity between the lead wire and the terminal fitting may occur due to the lead wire and the terminal fitting becoming separate after welding.

The present invention has been made to solve such problems, and aims to provide a method for manufacturing a coil component that enhances the reliability of the component as well as improving the work efficiency in manufacturing.

A coil component according to the present invention includes a main body portion structured with green compact containing magnetic material, a coil arranged inside the main body portion, a pair of lead wires each drawn out from the coil to outside of the main body portion, and a terminal fitting to be connected to the lead wire at the outside of the main body portion. The lead wire and the terminal fitting are welded to form welding portion. The pair of lead wires is both drawn out towards a first direction that is orthogonal to an axis direction of the coil. The main body portion includes a drawing surface where the lead wire is drawn out towards the outside, and the drawing surface is disposed towards the coil side from an end of the main body portion in the first direction and perpendicularly intersects the lead wire.

With the coil component thus structured, the pair of lead wires is both drawn out towards the first direction that is orthogonal to the axis direction of the coil. In other words, the pair of lead wires is mutually drawn out in the same direction. In the conventional coil component, because the lead wires are drawn out in different directions forming 180 degrees from each other, this requires forming of the lead wires to be bent, making it difficult to ensure the positional accuracy of the lead wires. On the other hand, in the structure of the coil component according to the present invention, because the pair of lead wires is drawn out in the same direction, the forming to provide a bent portion is not necessary, thereby facilitating the positioning of the lead wires. Accordingly, it makes it easier to realize the miniaturization of the component. Furthermore, in the coil component according to the present invention, the drawing surface of the main body portion is disposed towards the coil side from the end of the main body portion in the first direction. In other words, the lead wire is not protruded to the outside from the end of the main body portion in the first direction. With the foregoing structure, the welding portion formed to the lead wire can be disposed within the range of the outside dimension of the main body portion. This makes it easier to realize the miniaturization of the component. Furthermore, the drawing surface perpendicularly intersects the lead wire. For example, in the structure where the lead wire is drawn out at a slant from the drawing surface, it requires to make a play of the lead wire large between the drawing surface and the welding portion. When the play of the lead wire is large, there is a possibility that the shape of the welding portion for connecting the lead wire and the terminal fitting becomes unstable. Meanwhile, in the structure where the lead wire is perpendicularly drawn out from the drawing surface, it makes it possible to set the play of the lead wire small between the lead wire and the terminal fitting. Accordingly, when the play of the lead wire is set small, the shape of the welding portion for connecting the lead wire and the terminal fitting becomes stable. Consequently, with the coil component of the present invention, the component accuracy can be adequately secured even when miniaturization is pursued.

Furthermore, it is preferable that the terminal fitting includes a base body piece extending along a main surface of the main body portion that intersects the axis direction and connected to the main body portion and a welding piece extending along the lead wire and welded with the lead wire, the base body piece include a bonding surface to be bonded with the main surface and a mounting surface to be mounted on an external component at a rear surface side of the bonding surface, and the welding piece include a welding surface facing the lead wire. With the foregoing structure, the terminal fitting can sufficiently support the lead wire on the welding surface of the welding piece under the condition of the terminal fitting being sufficiently fixed to the main body portion by the base body piece having the bonding surface. Accordingly, in the welding work for forming the welding portion, the lead wire and the welding piece are welded under a stable condition. This makes it possible to perform the welding such that the play of the lead wires between the drawing surfaces and the welding portions becomes small.

It is preferable that the welding surface be higher in wettability for material constituting the lead wire than a rear surface of the welding surface of the welding piece. For example, if the rear surface of the welding surface has wettability that is the same as or higher than that of the welding surface, there is a possibility of the welding portion being polled towards the rear surface side. In this case, the shape of the welding portion may not be stabilized. On the other hand, in the coil component according to the present invention, the welding surface of the welding piece has higher wettability than that of the rear surface. Accordingly, the welding portion can be in a stable shape without being pulled towards the rear surface side.

It is preferable that the main body portion include inclined surface between the end in the first direction and the drawing surface, and the inclined surface be inclined so as to be away from the lead wire towards the first direction. With the foregoing structure, it makes it possible to prevent the heat produced when forming the welding portion from transferring to the main body portion via the inclined surface.

Furthermore, it is preferable that the pair of lead wires extend towards outside of the main body portion so as to spread wider from each other. With the foregoing structure, the drawing surfaces that draw out the pair of lead wires are disposed towards corner portion sides of the main body portion. The drawing surfaces are the surfaces disposed towards the coil side from the end of the main body portion. Accordingly, when the drawing surfaces are formed near the center position of the main body portion, there is a possibility of the wall thicknesses with respect to the coil near the drawing surfaces become small. In the coil component according to the present invention, because the drawing surfaces are disposed close to the corner portions, the wall thicknesses with respect to the coil can be secured sufficiently.

It is preferable that the main body portion has an outside dimension defined region that defines an outside dimension, and the welding portion be disposed within the outside dimension defined region. This makes it possible to prevent the welding portion from interfering with other components when the coil component is mounted on an external component.

It is preferable that the welding portion be separated from the drawing surface. Accordingly, it makes it possible to prevent the heat produced when forming the welding portion from transferring to the main body portion via the drawing surface.

A method for manufacturing a coil component according to the present invention is a method for manufacturing a coil component including a main body portion arranged with a coil inside thereof, a lead wire drawn out from the coil towards outside of the main body portion, and a terminal fitting to be connected with the lead wire at the outside of the main body portion. The method includes a step of preparing the main body portion arranged with the coil inside thereof and the lead wire drawn out, a step of preparing the terminal fitting including a welding piece extending along the lead wire and welded with the lead wire, a step of pressing the lead wire and the welding piece, and a step of welding pressed portions of the lead wire and the welding piece.

In the method for manufacturing a coil component, the lead wire and the welding piece of the terminal fitting are fixed and electrically connected to each other by welding. In this case, the lead wire and the weld piece are pressed with each other and welded at the pressed portions. In other words, the lead wire and the welding piece are welded under a securely fixed condition. This reliably prevents the lead wire and the welding piece from being separated after welding and ensures the connectivity between the lead wire and the terminal fitting. A simple work of only pressing the lead wire and the terminal fitting can fix the lead wire and the terminal fitting. Therefore, such pressure applying work can significantly simplify the movement of the work as well as simplifying the structure and the operation of the manufacturing apparatus, compared with when performing swaging work to swage the terminal fitting to the lead wire or the work of winding the lead wire to the terminal fitting. As a consequence, the work efficiency of the manufacturing can be improved and the reliability of the component can be enhanced.

It is preferable that the main body portion be structured with green compact containing magnetic material. The coil components by such green compact are demanded to be miniaturized in recent years and the component accuracy and the reliability thereof are required to be improved. According to the method for manufacturing a coil component of the present invention, by heightening the certainty of the welding work, the miniaturization of the coil component can be achieved.

Furthermore, it is preferable that the welding piece include a welding surface facing the lead wire, and the welding surface be higher in wettability for material constituting the lead wires than a rear surface of the welding surface of the welding piece. For example, when the rear surface of the welding surface has wettability that is the same as or higher than that of the welding surface, there is a possibility of the welding portion being pulled towards the rear surface side. In this case, there is a possibility that the shape of the welding portion becomes unstable. Meanwhile, in the method for manufacturing a coil component according to the present invention, the welding surface of the welding piece has higher wettability than that of the rear surface. Accordingly, the welding portion can be in a stable shape without being pulled towards the rear surface side.

It is preferable that the method further include a step of cutting at least the lead wire under a condition of pressing the lead wire and the welding piece. Accordingly, the cutting work of the lead wire can be performed securely and easily.

It is preferable that a pair of such lead wires be drawn out of the main body portion, and the pair of lead wires be both drawn out towards a first direction that is orthogonal to an axis direction of the coil. Accordingly, by drawing out the pair of lead wires in the same direction, when pressing, the pressure can be applied to both of the lead wires using a single pressure applying apparatus in a single action. This makes it possible to enhance the work efficiency.

It is preferable that, in the step of cutting the lead wire, a cut portion of the lead wire covers an end surface of the welding piece. Accordingly, the lead wire and the welding piece can be fixed more securely.

It is preferable that the main body portion include a drawing surface where the lead wire is drawn out towards outside, the drawing surface be disposed towards the coil portion side from an end of the main body portion in a drawing direction of the lead wire, and a welding portion formed by welding the lead wire and the welding piece be disposed between the drawing surface and the end portion. Accordingly, by performing the welding work such that the welding portion is disposed between the drawing surface and the end portion, stable work can be preformed reducing the play of the lead wire.

It is further preferable that, in the step of preparing the terminal fitting, a lead frame formed with a plurality of such terminal fittings be prepared. This makes it possible to process a plurality of coil components at a time, the step of applying a pressure and the step of performing the welding can be performed all at once.

According to the coil component of the present invention, the component accuracy can be adequately ensured even when miniaturization is pursued.

According to the method for manufacturing a coil component of the present invention, the reliability of the component can be enhanced and the work efficiency of the manufacturing can be improved.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Preferred embodiments of the present invention will now be described in details with reference to the accompanying drawings, wherein like numbers reference like elements and their redundant descriptions are omitted.

Figure 1:
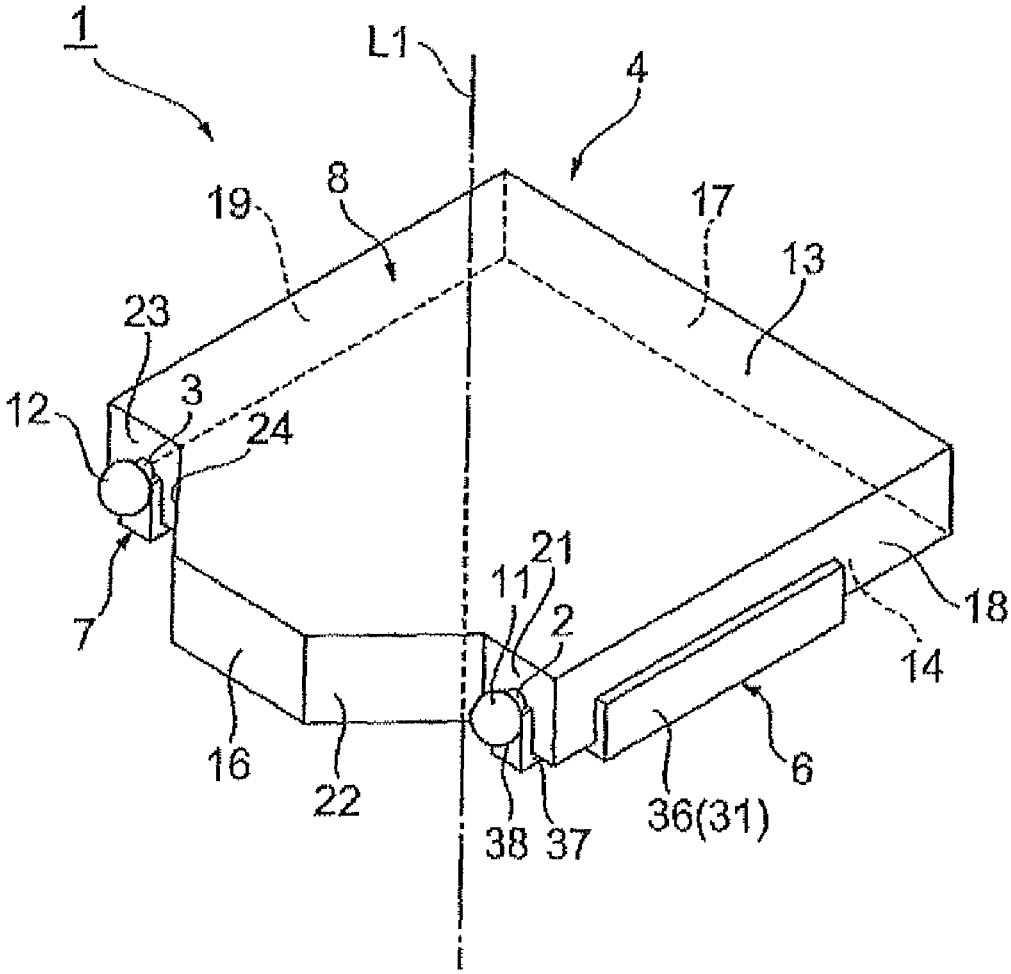
FIG. 1 is a perspective view of a coil component according to an embodiment.
Figure 2:
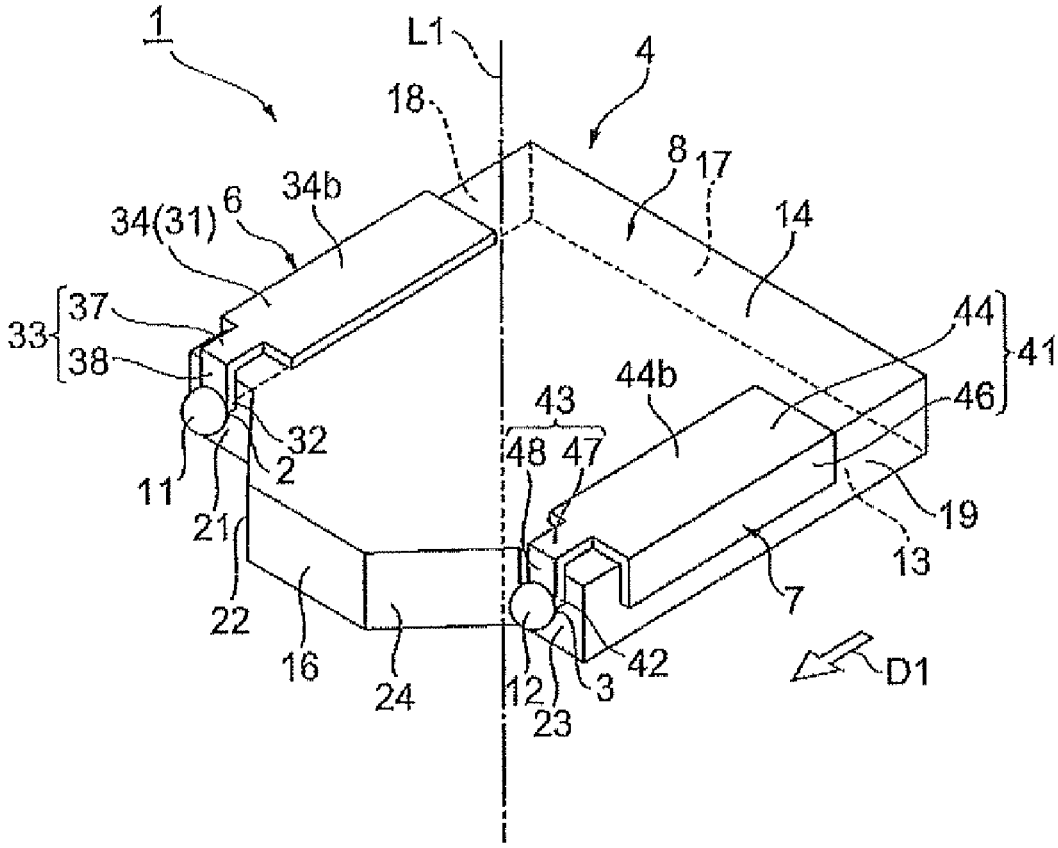
FIG. 2 is a perspective view of the coil component according to the embodiment viewed from a terminal fitting side.
Figure 3:
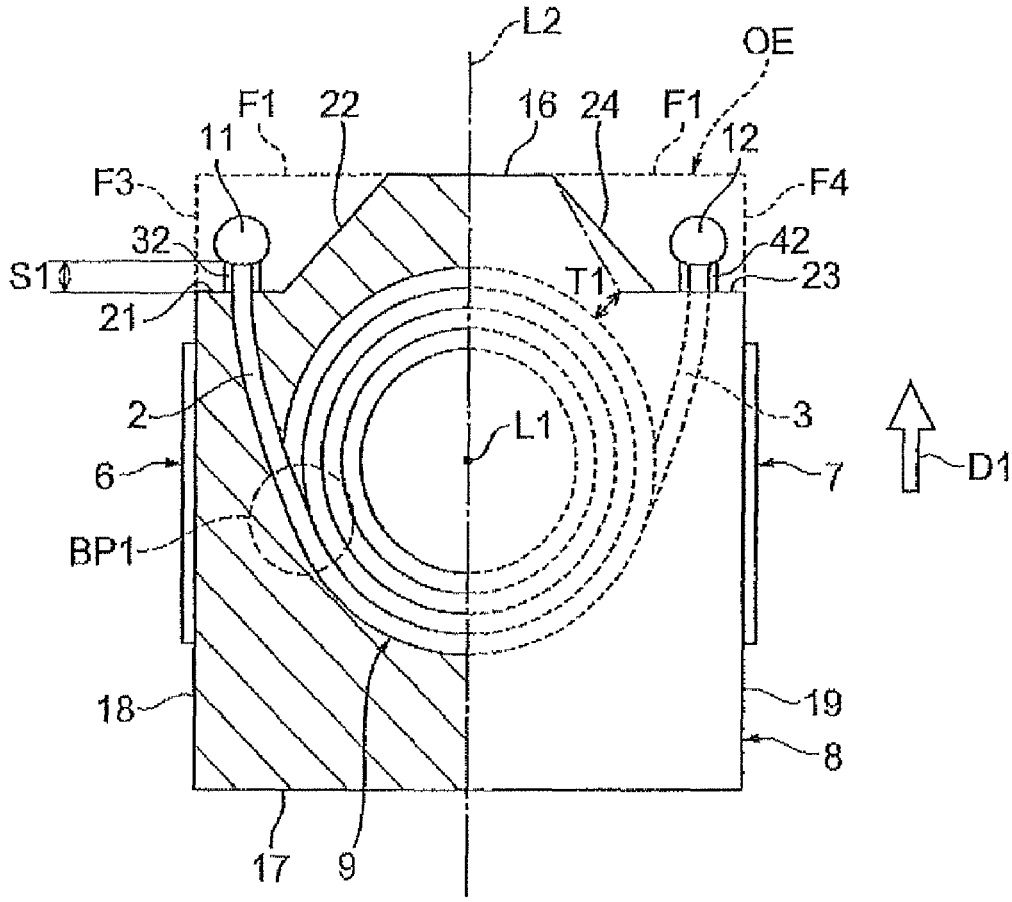
FIG. 3 is a plan view of the coil component depicted in FIG. 1 viewed from an axis direction of a coil.

With reference to FIGS. 1, 2 and 3, the structure of a coil component 1 according to an embodiment of the present invention will be explained. FIG. 1 is a perspective view of the coil component according to the embodiment of the present invention. FIG. 2 is a perspective view of the coil component according to the embodiment of the present invention viewed from a terminal fitting side. FIG. 3 is a plan view of the coil component depicted in FIG. 1 viewed from the axis direction of a coil. FIG. 3 indicates a coil 9 in the left half area of the drawing with a main body portion 8 being cutaway.

As depicted in FIGS. 1, 2 and 3, the coil component 1 is structured to include a compact body 4 with lead wires 2 and 3 drawn out, and terminal fittings 6 and 7 attached to the compact body 4. By welding the lead wire 2 and the terminal fitting 6, a welding portion 11 is formed and by welding the lead wire 3 and the terminal fitting 7, a welding portion 12 is formed. The compact body 4 includes a main body portion 8 structured with green compact containing magnetic material, the coil 9 arranged inside the main body portion 8, and the pair of lead wires 2 and 3 each drawn out from the coil 9 to the outside of the main body portion 8. The compact body 4 is constructed by integral molding of magnetic powder with the coil arranged therein. The terminal fitting 6 is bonded to the compact body 4 and is electrically connected to the lead wire 2 exposed to the outside via the welding portion 11. The terminal fitting 7 is bonded to the compact body 4 and is electrically connected to the lead wire 3 exposed to the outside via the welding portion 12.

The magnetic material constituting the main body portion 8 includes, for example, ferrite powder and ferromagnetic metal powder. The main body portion 8 has a flat and generally rectangular shape, and the outside dimension is set as a matter of 2.5 to 5 millimeters long, 2.5 to 5 millimeters wide, and 1.0 to 2.0 millimeters high. The main body portion 8 has a first main surface 13 and a second main surface 14 facing each other in a thickness direction, has a first side surface 16 and a second side surface 17 facing each other and orthogonal to the first main surface 13 and the second main surface 14, and has a third side surface 18 and a fourth side surface 19 facing each other, orthogonal to the first main surface 13 and the second main surface 14, and orthogonal to the first side surface 16 and the second side surface 17. The following explanation here is made with the direction going from the second side surface 17 towards the first side surface 16 defined as a first direction D1. When the first direction D1 is defined this way, the first side surface 16 corresponds to an end of the main body portion 8 in the first direction D1.

The main body portion 8 has a shape that is like a corner portion between the first side surface 16 and the third side surface 18 being cutout. More specifically, the main body portion 8 has a thawing surface 21 and an inclined surface 22 that are orthogonal to the fast main surface 13 and the second main surface 14 between the first side surface 16 and the third side surface 18. The drawing surface 21 has a function to draw out the lead wire 2 to the outside. The drawing surface 21 is perpendicularly connected to the third side surface 18 and is in parallel with the first side surface 16 and the second side surface 17. The drawing surface 21 is disposed towards the coil 9 side, viz., the second side surface 17 side, from the first side surface 16 that is the end of the main body portion 8 in the first direction D1. The inclined surface 22 is provided between the first side surface 16 and the drawing surface 21. The inclined surface 22 is inclined so that the main body portion 8 is tapered from the drawing surface 21 towards the first direction D1. With reference to a later described position of the welding portion 11, the inclined surface 22 is inclined towards the first direction D1 so as to be further away from the lead wire 2, i.e., the welding portion 11.

The main body portion 8 has a shape that is like a corner portion between the first side surface 16 and the fourth side surface 19 being cutout. More specifically, the main body portion 8 has a drawing surface 23 and an inclined surface 24 that are orthogonal to the first main surface 13 and the second main surface 14 between the first side surface 16 and the fourth side surface 19. The drawing surface 23 has a function to draw out the lead wire 3 to the outside. The drawing surface 23 is perpendicularly connected to the fourth side surface 19 and is in parallel with the first side surface 16 and the second side surface 17. The drawing surface 23 is disposed towards the coil 9 side, viz., the second side surface 17 side, from the first side surface 16 that is the end of the main body portion 8 in the first direction D1. The inclined surface 24 is provided between the first side surface 16 and the drawing surface 23. The inclined surface 24 is inclined so that the main body portion 8 is tapered from the drawing surface 23 towards the first direction D1. With reference to a later described position of the welding portion 12, the inclined surface 24 is inclined so as to be away from the lead wire 3, i.e., the welding portion 12, towards the first direction D1.

As depicted in FIG. 3, the coil 9 is constructed by winding a winding wire around a central axis L1 (in FIG. 3, extending in a perpendicular direction to the drawing surface). The coil 9 is arranged such that its central axis L1 coincides with the thickness direction of the main body portion 8. In other words, the axis direction of the coil 9 is orthogonal to the first direction D1. The central axis L1 is arranged at a center position of the outside dimension region of the main body portion 8 viewed from the thickness direction thereof. Out of the winding wire of the coil 9, one end is drawn out to the outside of the main body portion 8 as the lead wire 2, while the other end is drawn out to the outside of the main body portion 8 as the lead wire 3. The lead wire 2 and the lead wire 3 are both drawn out towards the first direction D1. More specifically, the lead wire 2 and the lead wire 3 are both drawn out in the direction from the second side surface 17 towards the first side surface 16. The lead wire 2 extends towards the drawing surface 21 along the third side surface 18 and is drawn outside of the main body portion 8 at the drawing surface 21. The lead wire 3 extends towards the drawing surface 23 along the fourth side surface 19 and is drawn outside of the main body portion 8 at the drawing surface 23. The portion between the lead wire 2 and the winding wire of the coil 9, more specifically, the portion where the lead wire 2 comes apart from the winding direction of the coil 9 (the portion indicated by Bpl in FIG. 3) and the portion between the lead wire 3 and the winding wire of the coil 9 form a phase of 180 degrees.

The lead wire 2 is drawn out so as to perpendicularly intersect the drawing surface 21. The lead wire 3 is drawn out so as to perpendicularly intersect the drawing surface 23. The term perpendicular used here means to include being perpendicular within the range of an error that occurs in manufacturing as well as the state of being completely perpendicular. The lead wire 2 and the lead wire 3 extend from the coil 9 towards the first direction D1 so as to spread wider from each other. More specifically, with a center line between the third side surface 18 and the fourth side surface 19 defined as L2, the lead wire 2 extends from the coil 9 in the first direction D1 so as to be away from the center line L2 and to approach the third side surface 18. Meanwhile, the lead wire 3 extends from the coil 9 in the first direction D1 so as to be away from the center line L2 and to approach the fourth side surface 19. The lead wire 2 is smoothly drawn out without bending at the portion (the portion indicated by BP1 in FIG. 3) between the lead wire 2 and the winding wire portion of the coil 9 that is wound in a circle. In other words, the lead wire 2 is in a shape close to a tangent line to the coil 9 at the portion BP1 where the lead wire 2 aparts from the winding wire portion of the coil 9. The lead wire 3 is similarly arranged.

The tip of the lead wire 2 has the welding portion 11 by being welded to the terminal fitting 6. The tip of the lead wire 3 has the welding portion 12 by being welded to the terminal fitting 7. The welding portion 11 and the welding portion 12 are disposed within an outside dimension defined region OE of the main body portion 8. The outside dimension defined region OE is a hexahedral region set for defining the outside dimension of the longitudinal, traverse, and length of the main body portion 8. When designing a product using the coil component 1, the designing is made based on the outside dimension defined by the outside dimension defined region. In the present embodiment, the outside dimension defined region OE is defined by a region surrounded by a plane extended to include the first main surface 13, a plane extended to include the second main surface 14, a plane extended to include the first side surface 16, a plane extended to include the second side surface 17, a plane extended to include the third side surface 18, and a plane extended to include the fourth side surface 19. In the present embodiment, the drawing surfaces 21 and 23 and the inclined surfaces 22 and 24 are disposed within the outside dimension defined region OE. In FIG. 3, out of six planes defining the outside dimension defined region OE, parts of the planes in parallel with the central axis L1 of the coil 9 are depicted in dotted lines. More specifically, a plane F1 extended to include the first side surface 16, a plane F3 extended to include the third side surface 18, and a plane F4 extended to include the fourth side surface 19 are depicted. The welding portion 11 is disposed towards the coil 9 side from the plane F1 (first side surface 16) and towards the coil 9 side from the plane F3 (third side surface 18). The welding portion 12 is disposed towards the coil 9 side from the plane F1 (first side surface 16) and towards the coil 9 side from the plane F4 (fourth side surface 19). As obvious from FIGS. 1 and 2, the welding portions 11 and 12 are disposed between the first main surface 13 and the second main surface 14 and are also disposed within the outside dimension defined region OE in the thickness direction. The welding portion 11 and the welding portion 12 are separated from the drawing surfaces 21 and 23, respectively. More specifically, it is preferable that the dimension of the portion indicated by S1 in FIG. 3 be a matter of 0.05 to 0.1 millimeter.

Figure 4:
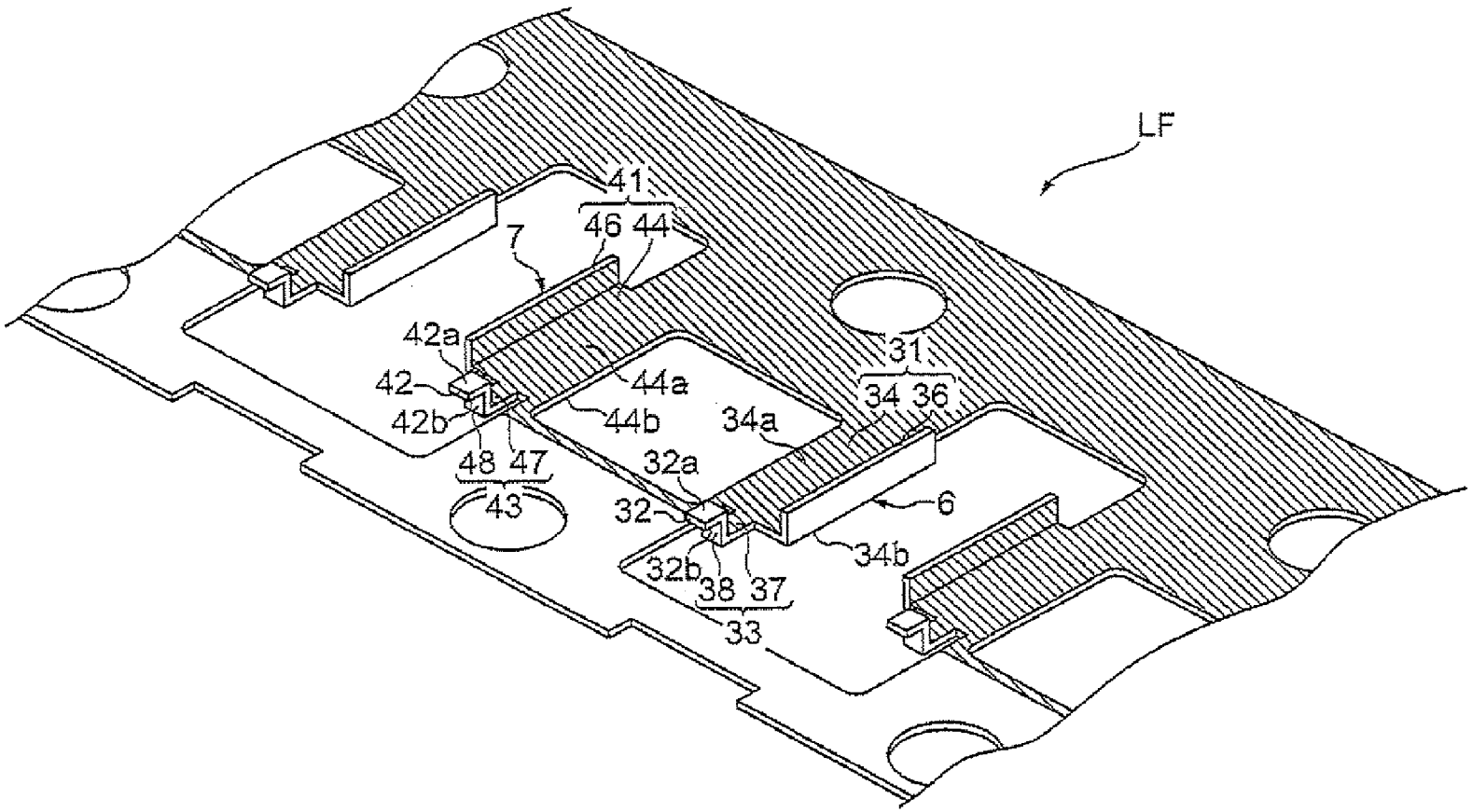
FIG. 4 is a perspective view of terminal fittings depicted in a state of being connected to a lead frame.
Figure 5:
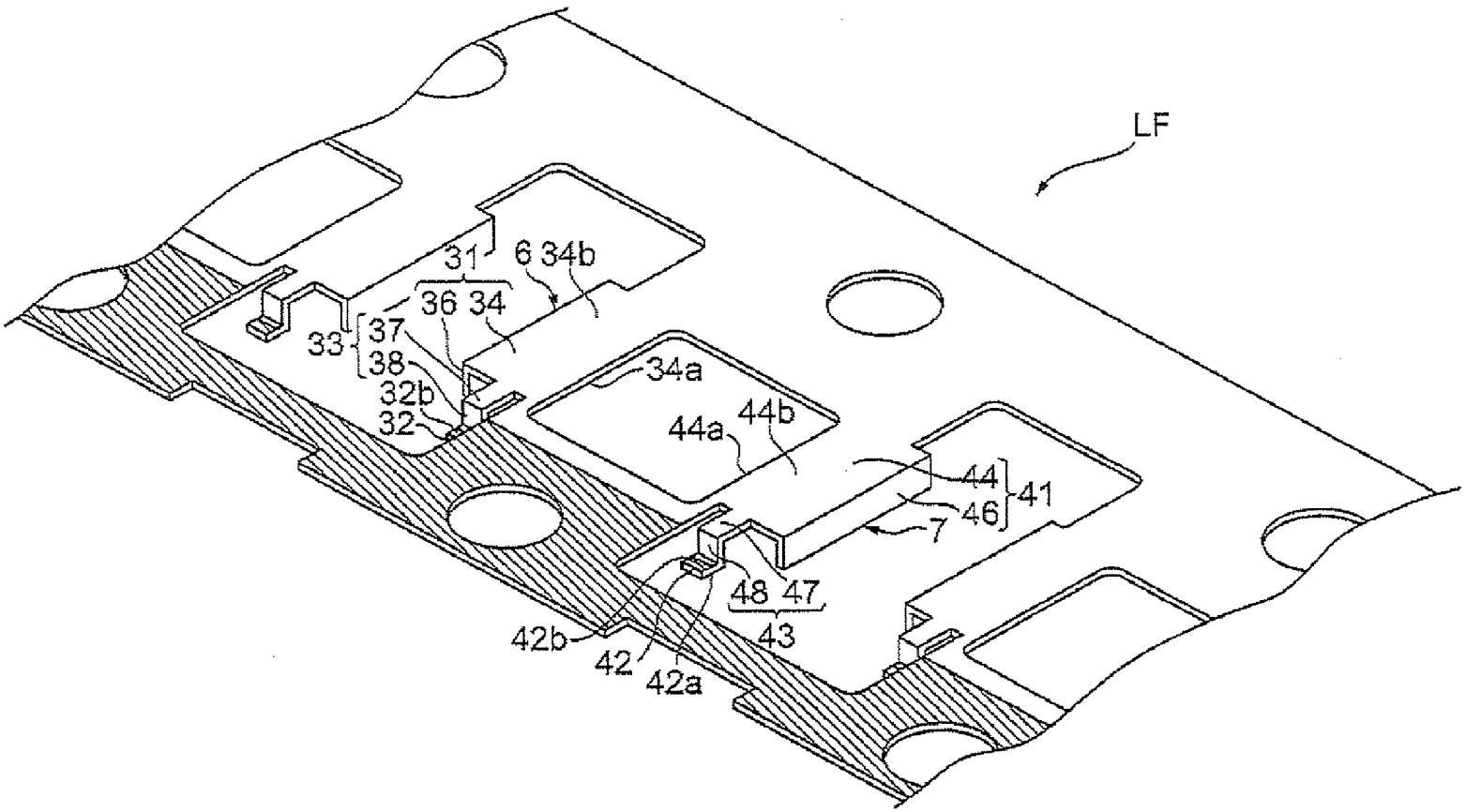
FIG. 5 is a perspective view depicting a rear surface side of the terminal fittings in the state of being connected to the lead frame.

FIG. 4 is a perspective view indicating terminal fittings in a state of being connected to a lead frame. FIG. 5 is a perspective view indicating a rear surface side of the terminal fittings in the state of being connected to the lead frame. At the time of manufacturing, the terminal fittings 6 and 7 are bonded and welded to the compact body 4 in a state that a plurality of terminal fittings is connected to a lead frame LF. As depicted in FIGS. 1, 2, 4, and 5, the terminal fitting 6 includes a base body piece 31 extending along the second main surface 14 that intersects the central axis L1 of the main body portion 8 and connected to the main body portion 8, a welding piece 32 extending along the lead wire 2 and welded with the lead wire 2, and a connecting piece 33 connecting the base body piece 31 and the welding piece 32. The base body piece 31 is a plate material of an L-shaped cross-sectional surface and has a bottom portion 34 that contacts the second main surface 14, and a side portion 36 that faces the third side surface 18. The connecting piece 33 is a strip-shaped member of an L-shaped cross-sectional surface and has a horizontal portion 37 horizontally extending from the bottom portion 34 in the first direction D1 and a perpendicular portion 38 perpendicularly extending along the drawing surface 21 from an end portion of the horizontal portion 37 towards the welding piece 32. The bottom portion 34 of the base body piece 31 has a bonding surface 34*a* to be bonded to the second main surface, and has a mounting surface 34*b* to be mounted on an external component (such as a substrate) at the rear surface side of the bonding surface 34*a*. The welding piece 32 has a welding surface 32*a* that faces the lead wire 2. The terminal fitting 7 includes a base body piece 41 extending along the second main surface 14 that intersects the central axis L1 of the main body portion 8 and connected to the main body portion 8, a welding piece 42 extending along the lead wire 3 and welded with the lead wire 3, and a connecting piece 43 that connects the base body piece 41 and the welding piece 42. The base body piece 41 is a plate material of an L-shaped cross-sectional surface and has a bottom portion 44 that contacts the second main surface 14, and a side portion 46 that contacts the fourth side surface 19. The connecting piece 43 is a strip-shaped member of an L-shaped cross-sectional surface and has a horizontal portion 47 horizontally extending from the bottom portion 44 in the first direction D1 and a perpendicular portion 48 perpendicularly extending along the drawing surface 23 from an end portion of the horizontal portion 47 towards the welding piece 42. The bottom portion 44 of the base body piece 41 has a bonding surface 44*a* to be bonded to the second main surface and has a mounting surface 44*b* to be mounted on an external component (such as a substrate) at the rear surface side of the bonding surface 44*a*. The welding piece 42 has a welding surface 42*a* that faces the lead wire 3.

The surfaces of the terminal fittings 6 and 7 have different wettability depending on the position. The wettability is the wettability with respect to the material constituting the lead wires 2 and 3. More specifically, the welding surfaces 32*a* and 42*a* of the welding pieces 32 and 42, the mounting surfaces 34*b* and 44*b* of the bottom portions 34 and 44 of the base body pieces 31 and 41, the surfaces of the side portions 36 and 46 of the base body pieces 31 and 41 on the opposite side of the main body portion 8, and the surfaces of the horizontal portions 37 and 47 and the perpendicular portions 38 and 48 of the connecting pieces 33 and 43 on the opposite side of the main body portion 8 are plated on the respective surfaces, and are of the surfaces having high wettability. An example of plating used includes a Ni plating of about 0.5 micrometer in thickness and a Sn plating of about 5 micrometers in thickness. The Sn plating is formed on the Ni plating, and thus the outermost exterior is Sn plated. On the other hand, rear surfaces 32*b* and 42*b* of the welding surfaces 32*a* and 42*a* of the welding pieces 32 and 42, the bonding surfaces 34*a* and 44*a* of the bottom portions 34 and 44 of the base body pieces 31 and 41, the surfaces of the side portions 36 and 46 of the base body pieces 31 and 41 facing the main body portion 8, and the surfaces of the horizontal portions 37 and 47 and the perpendicular portions 38 and 48 of the connecting pieces 33 and 43 facing the main body portion 8 expose a copper surface, and are of the surfaces having low wettability (hatched portions indicated in FIGS. 4 and 5). Accordingly, the welding surfaces 32*a* and 42*a* of the welding pieces 32 and 42 have higher wettability than that of the rear surfaces 32*b* and 42*b*. The Mounting surfaces 34*b* and 44*b* of the bottom portions 34 and 44 of the base body pieces 31 and 41 are high in wettability and are easier to mount on other components. The boding surfaces 34*a* and 44*a* of the bottom portions 34 and 44 of the base body pieces 31 and 41 expose the copper surface and are low in wettability, and are easier to bond with the main body portion 8. It is preferable that at least the welding surfaces 32*a* and 42*a* and the mounting surfaces 34*b* and 44*b* be the plated surfaces and at least the rear surfaces 32*b* and 42*b* (particularly the portions of the tip sides where the welding portions 11 and 12 are formed) and the bonding surfaces 34*a* and 44*a* be the copper surfaces. The other portions may be either of a plated surface or a copper surface.

The method for manufacturing the coil component 1 will be explained with reference to FIG. 6, FIGS. 7A to 7C, and FIGS. 8A to 8D.

Figure 6:
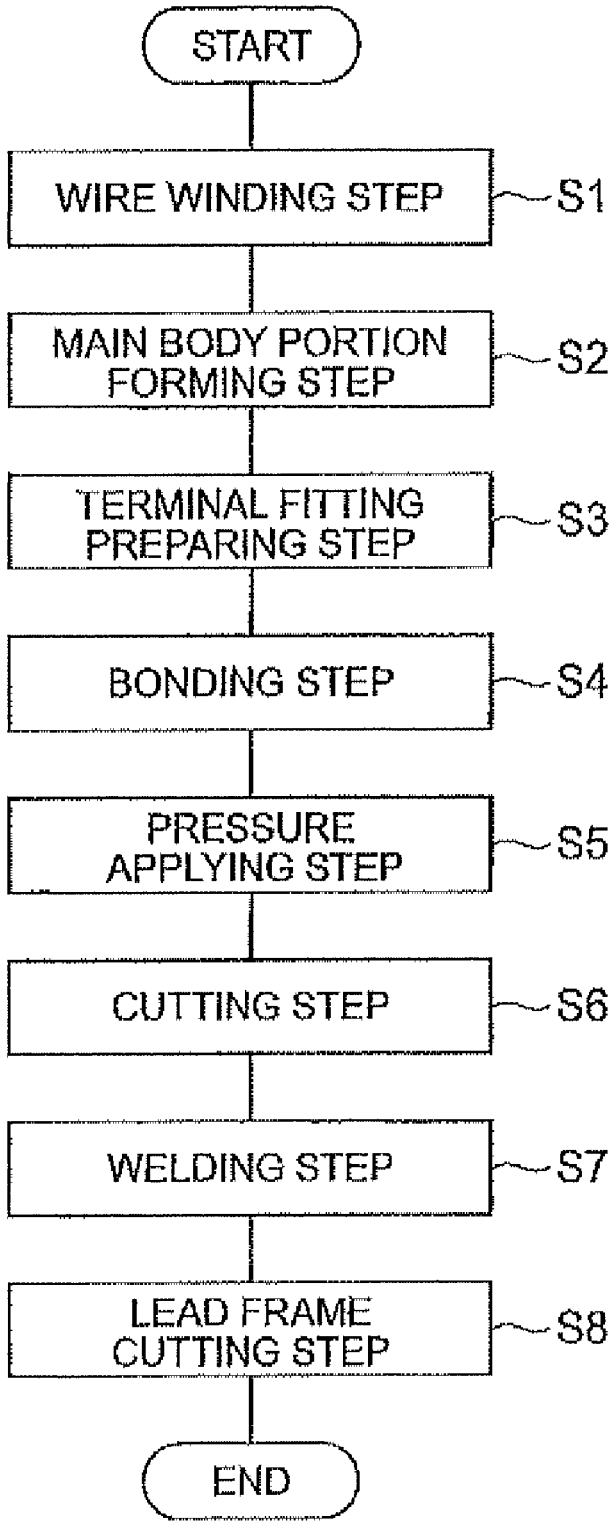
FIG. 6 is a flowchart indicating a manufacturing method for the coil component according to the embodiment.
Figure 7:
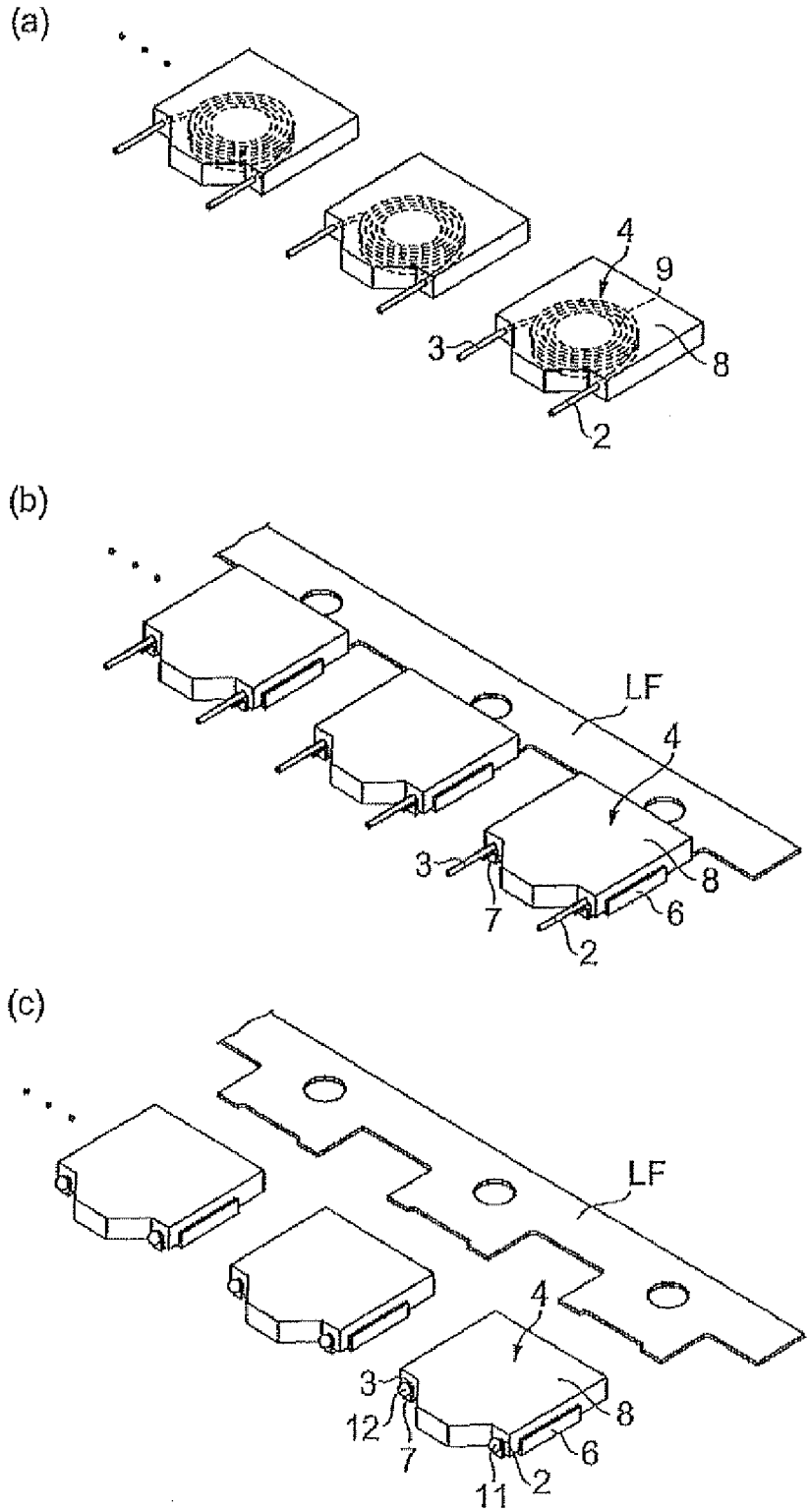
FIGS. 7A to 7C are perspective views illustrating the manufacturing method for the coil component according to the embodiment.

As indicated in FIG. 6, a wire winding step S1 is carried out. The wire winding step S1 is, as depicted in FIG. 7A, the step to form the coil 9 by winding the winding wire, as well as to draw out the lead wires 2 and 3. Then, a main body portion forming step S2 to form the main body portion 8 is carried out. The main body portion forming step S2 is the step to form the main body portion 8 by integral molding of the magnetic material with the coil 9. The compact bodies 4 indicated in FIG. 7A are formed by carrying out the wire winding step S1 and the main body portion forming step S2. In other words, the wire winding step S1 and, the main body portion forming step S2 constitute a step of preparing the main body portion 8 arranged with the coil 9 inside and the lead wires 2 and 3 drawn out.

A terminal fitting preparing step S3 is then carried out. The terminal fitting preparing step S3 is the step to form the terminal fittings 6 and 7 being connected to the lead frame LF by pressing or the like, as well as to apply plating on the surfaces of the terminal fittings 6 and 7 (see FIGS. 4 and 5). Then, a bonding step S4 is carried out. The boding step S4 is the step to bond the terminal fittings 6 and 7 to the compact body 4. In the bonding step S4, adhesive is applied on the bonding surfaces 34*a* and 44*a* of the terminal fittings 6 and 7 and, as illustrated in FIG. 7B, the bonding surfaces 34*a* and 44*a* are bonded to the main body portion 8 of the compact body 4. In the bonding step S4, the terminal fittings 6 and 7 with the lead frame LF attached are bonded to the compact bodies 4 that are lined up and secured in a row. Alternatively, the compact bodies 4 may be bonded to the terminal fittings 6 and 7 that are secured.

Then, a pressure applying step S5 is carried out. The pressure applying step S5 is the step in which the lead wires 2 and 3 and the welding pieces 32 and 42 of the terminal fittings 6 and 7 are pressed. A cutting step S6 is then carried out. The cutting step S6 is the step to cut the portions of the lead wires 2 and 3 that are too long. Then, a welding step S7 is carried out. The welding step S7 is, as illustrated in FIG. 7C, the step to form the welding portions 11 and 12 at the tips of the lead wires 2 and 3. More specifically, in the welding step S7, the pressed portions of the lead wires 2 and 3 and the welding pieces 32 and 42 of the terminal fittings 6 and 7 are welded.

Figure 8:
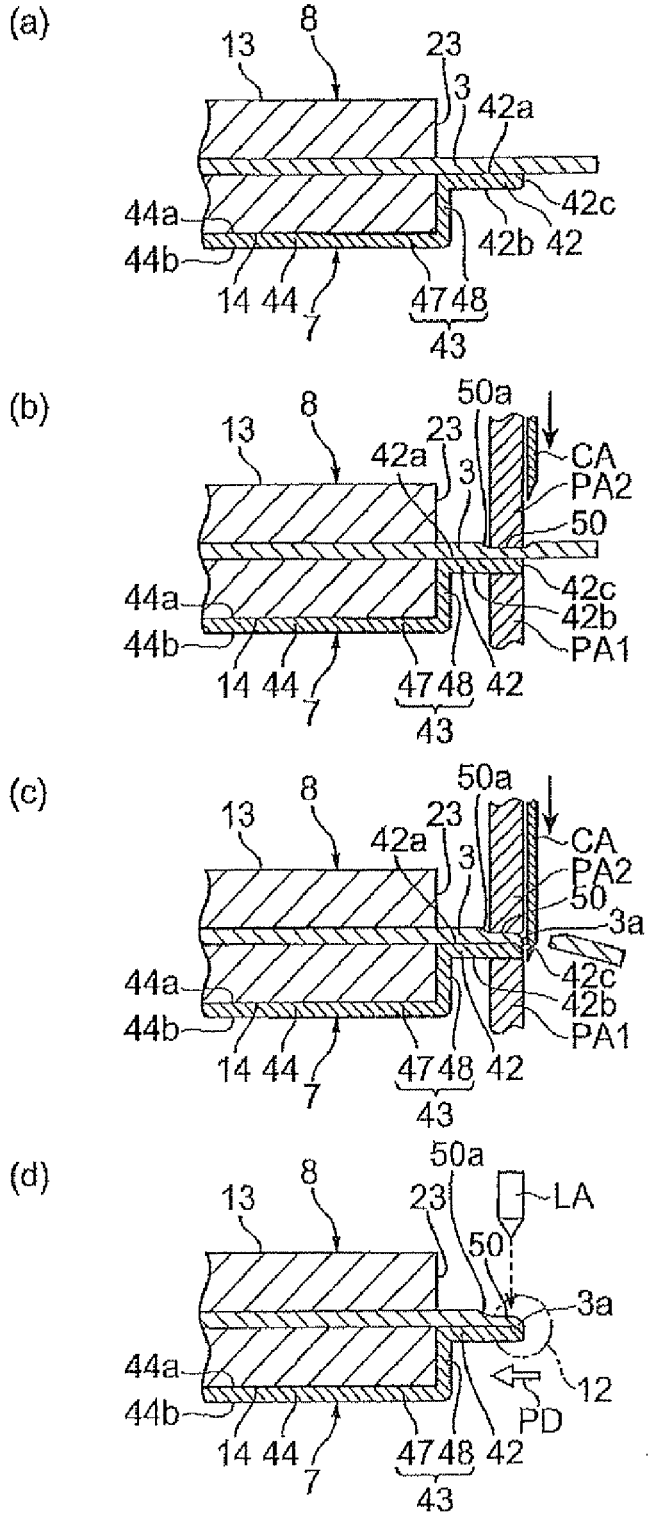
FIGS. 8A to 8D are schematic cross-sectional views for explaining processes from a bonding step S4 to a welding step S7.

With reference to FIGS. 8A to 8D, the processes of the bonding step S4 to the welding step S7 will be described in detail. While FIGS. 8A to 8D only illustrate the conditions of the lead wire 3 side out of the lead wires 2 and 3, similar processes are also performed on the lead wire 2 side. As depicted in FIG. 8A, in the bonding step S4, the bonding surface 44*a* of the terminal fitting 7 is bonded to the second main surface 14 of the main body portion 8 via the adhesive. In this case, the lead wire 3 is placed on the welding surface 42*a* of the welding piece 42 of the terminal fitting 7. Then, as depicted in FIG. 8B, in the pressure applying step S5, the lead wire 3 is pressed to the welding surface 42*a* of the welding piece 42 of the terminal fitting 7. More specifically, the rear surface 42*b* of the terminal fitting 7 is supported on an upper surface of a pressure applying tool PA1 and the lead wire 3 is pressed by a pressure applying tool PA2 from the above. Accordingly, the lead wire 3 and the welding piece 42 are pinched between the pressure applying tool PA1 and the pressure applying tool PA2. At the portion of the lead wire 3 and the welding piece 42 being pinched, a pressure applying portion 50 is formed. At the pressure applying portion 50, the lead wire 3 and the welding piece 42 are in a flat crushed shape compared with other portions. The "pressure applying portion 50" includes not only the position directly contacting the pressure applying tools PA1 and PA2, but also the vicinities of the contacting position. More specifically, the "pressure applying portion 50" includes the area that is strained and deformed by the pressing force of the pressure applying tools PA1 and PA2 even it is not making contact with these tools (for example, portion indicated by 50*a* in FIGS. 8B to 8D).

Then, as depicted in FIG. 8C, in the cutting step S6, the lead wire 3 is cut by a cutting tool CA. More specifically, under the condition that the lead wire 3 and the welding piece 42 are being pinched by the pressure applying tools PA1 and PAZ the lead wire 3 is cut by the cutting tool CA. The cutting tool CA cuts towards the tip side of the lead wire 3 from the pressure applying portion 50. In this case, a cut portion 3*a* of the lead wire 3 covers an end surface 42*c* of the welding piece 42. In other words, by being cut with the cutting tool CA, the cut portion 3*a* of the lead wire 3 is pulled along the cutting direction and edges into the welding piece 42 side. Consequently, even before the welding, the positional relation between the lead wire 3 and the welding piece 42 is fixed (like in a temporary joint state) by the cut portion 3*a*. In FIG. 8C, while it is depicted such that the lead wire 3 only is cut, a part of the welding piece 42 may be cut at the same time as the lead wire 3. When cutting the welding piece 42 and the lead wire 3 at the same time, the cut portion 3*a* that covers the end surface of the welding piece 42 becomes even larger. Then, in the welding step S7, as depicted in FIG. 8D, a laser welding apparatus LA irradiates the pressure applying portion 50 of the lead wire 3 and the welding piece 42 with laser. Accordingly, at the pressure applying portion 50, the welding portion 12 connecting the lead wire 3 and the welding piece 42 is formed. Because heat is applied to the position that is irradiated with the laser by the laser welding apparatus LA, the heat is transferred towards the main body portion 8 side. Consequently, as indicated by the arrow PD, the welding portion 12 moves towards the main body portion 8 side from a laser irradiation position along with the heat transfer. This can ensure that the welding portion 12 is positioned within the outside dimension defined region OE of the main body portion 8. The laser irradiation position is not specifically limited and may be at any part of the pressure applying portion 50 as long as the welding portions 11 and 12 can eventually be disposed within the outside dimension defined region OE of the main body portion 8. For example, the tip side of the pressure applying portion 50 (i.e., a position close to the cut portion) may be irradiated with the laser or the base side of the pressure applying portion 50 (i.e., a position close to the main body portion 8, such as an area 50*a*) may be irradiated with the laser. When the base side of the pressure applying portion 50 is irradiated with the laser, the lead wires 2 and 3 and the welding pieces 32 and 42 at the tip side from the laser irradiation position are cut off.

Because the lead wire 2 and the lead wire 3 are drawn out to the same direction of the first direction D1, the position of forming the welding portion 11 and the position of forming the welding portion 12 are constructed to line as a horizontal straight line. Therefore, applying the pressure between the lead wire 2 and the welding piece 32 and between the lead wire 3 and the welding piece 42 can be performed using a single pressure applying tool PA1 and a single pressure applying tool PA2 in a single action. The cutting can be performed using a single cutting tool CA in a single action. Furthermore, in the present embodiment, because multiple pieces of each of the terminal fittings 6 and 7 are connected to the lead frame LF as depicted in FIGS. 7A to 7C, a plurality of main body portions 8 can be lined in a horizontal row. Therefore, for a plurality of the coil components 1, applying the pressure can be performed using a single pressure applying tool PA1 and a single pressure applying tool PA2 in a single action and the cutting can be performed using a single cutting tool CA in a single action. The laser welding apparatus LA only needs to move in a horizontal direction to form the welding portions of each of the coil components 1, thereby alleviating computational load for the positioning when welding.

Referring back to FIG. 7C, after the welding step S7, a lead frame cutting step S8 is executed. In the lead frame cutting step S8, the lead frame LF connecting the multiple pieces of terminal fittings 6 and 7 is cut off from each of the terminal fittings 6 and 7. Consequently, each of the coil components 1 becomes an individual component. By carrying out the lead frame cutting step S8, the manufacturing process indicated in FIG. 6 is finished.

The function and effect of the coil component 1 and the method for manufacturing the same according to the present embodiment will be described.

Figure 9:
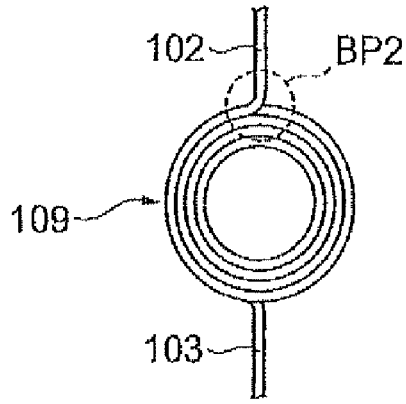
FIGS. 9A to 9D are diagrams for explaining function and effect of the coil component according to the embodiment.
Figure 9:
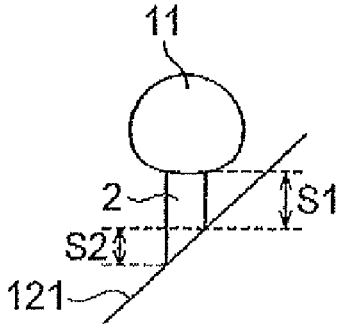
Figure 9:
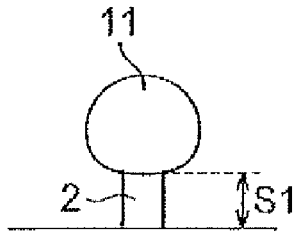
Figure 9:
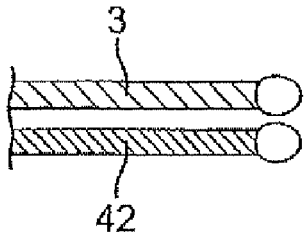

According to the coil component 1 of the present embodiment, the pair of lead wires 2 and 3 is both drawn out towards the first direction D1 orthogonal to the axis direction of the coil 9. In other words, the pair of lead wires 2 and 3 is mutually drawn out in the same direction. The structure of a conventional coil component depicted in FIG. 9A is explained. A coil portion 109 of the conventional coil component has lead wires 102, 103 drawn out in directions different from each other forming 180 degrees. A phase of 180 degrees is formed between the portion between the lead wire 102 and a winding wire of the coil 109 (the portion indicated by BP2 in FIG. 9A) and the portion between the lead wire 103 and the winding wire of the coil 109. Accordingly, at the portions between the lead wires 102, 103 and the winding wire of the coil 109, bent portions are formed. When forming the lead wires 102, 103 so as to be bent, there is a possibility of being difficult to ensure the positional accuracy of the lead wires 102, 103. Such a problem is more likely to occur, particularly when the miniaturization of the coil component is pursued. Furthermore, when the diameter of the lead wires 102, 103 becomes smaller with the miniaturization, it becomes difficult to maintain the bent shape. On the other hand, according to the structure of the coil component 1 of the present embodiment, the pair of lead wires 2 and 3 is drawn out in the same direction as indicated by BP1 in FIG. 3 and therefore, it is not necessary to bend between the lead wires 2 and 3 and the winding wire of the coil 9. Accordingly, the forming to provide bent portions is not necessary, thereby facilitating the positioning of the lead wires 2 and 3. Consequently, it makes it easier to realize the miniaturization of the component.

In the coil component 1 according to the present embodiment, the drawing surfaces 21 and 23 of the main body portion 8 are disposed towards the coil 9 side from the first side surface 16 that is the end of the main body portion 8 in the first direction D1. In other words, the lead wires 2 and 3 are not protruded to the outside of the first side surface 16 of the end of the main body portion 8 in the first direction D1. With the foregoing structure, the welding portions 11 and 12 formed to the lead wires 2 and 3 can be disposed within the range of the outside dimension defined region OE of the main body portion 8. This makes it easier to realize the miniaturization of the component. The drawing surfaces 21 and 23 perpendicularly intersect the lead wires 2 and 3. For example, as depicted in FIG. 9B, in a structure where the lead wire 2 is drawn out at a slant from the drawing surface 121, it becomes necessary to make a play of the lead wire 2 large between the welding portion 11 and the drawn surface 121. More specifically, to secure a distance of S1 between the drawing surface 121 and the welding portion 11, an extra play indicated by S2 in FIG. 913 becomes necessary. When the plays of the lead wires 2 and 3 are large, there is a possibility that the shapes of the welding portions 11 and 12 for connecting the lead wires 2 and 3 and the terminal fittings 6 and 7 become unstable. For example, as illustrated in FIG. 9D, there is a possibility that the welding portions become loose easily. On the contrary, in a structure where the lead wires 2 and 3 are perpendicularly drawn out from the drawing surfaces 21 and 23, it is possible to set the plays of the lead wires 2 and 3 small between the drawing surfaces 21 and 23 and the welding portions 11 and 12. More specifically, as illustrated in FIG. 9C, to secure the distance of S1 between the welding portion 11 and the drawing surface 21, it is not, necessary to provide any extra play. Accordingly, when the plays of the lead wires 2 and 3 are set small, the shapes of the welding portions 11 and 12 for connecting the lead wires 2 and 3 to the terminal fittings 6 and 7 become stable. Consequently, according to the coil component 1 of the present embodiment, the component accuracy can be adequately ensured even when miniaturization is pursued.

In the coil component 1 according to the present embodiment, the terminal fittings 6 and 7 have the base body pieces 31 and 41 extending along the second main surface 14 of the main body portion 8 and connected to the main body portion 8, and the welding pieces 32 and 42 extending along the lead wires 2 and 3 and welded together with the lead wires 2 and 3, respectively. The base body pieces 31 and 41 have the bonding surfaces 34*a* and 44*a* to be bonded with the second main surface 14, and the mounting surfaces 34*b* and 44*b* to be mounted on an external component at the rear surface sides of the bonding surfaces 34*a* and 44*a*, respectively. The welding pieces 32 and 42 have the welding surfaces 32*a* and 42*a* facing the lead wires 2 and 3, respectively. With the foregoing structure, while the terminal fittings 6 and 7 are adequately secured to the main body portion 8 at the base body pieces 31 and 41 having the bonding surfaces 34*a* and 44*a*, the terminal fittings 6 and 7 can sufficiently support the lead wires 2 and 3 on the welding surfaces 32*a* and 42*a* of the welding pieces 32 and 42. Accordingly, in the welding work to form the welding portions 11 and 12, the lead wires 2 and 3 and the welding pieces 32 and 42 are welded in a stable condition. This makes it possible to weld such that the plays of the lead wires 2 and 3 between the drawing surfaces 21 and 23 and the welding portions 11 and 12 become small.

Figure 10:
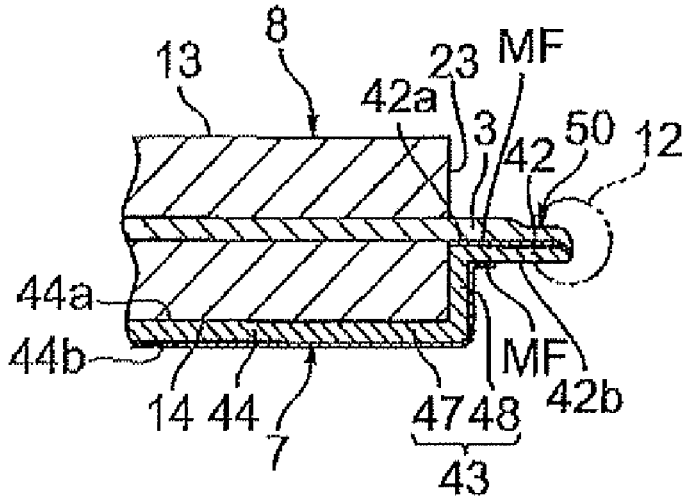
FIGS. 10A and 10B are schematic cross-sectional views for explaining the function and effect of the coil component according to the embodiment.
Figure 10:
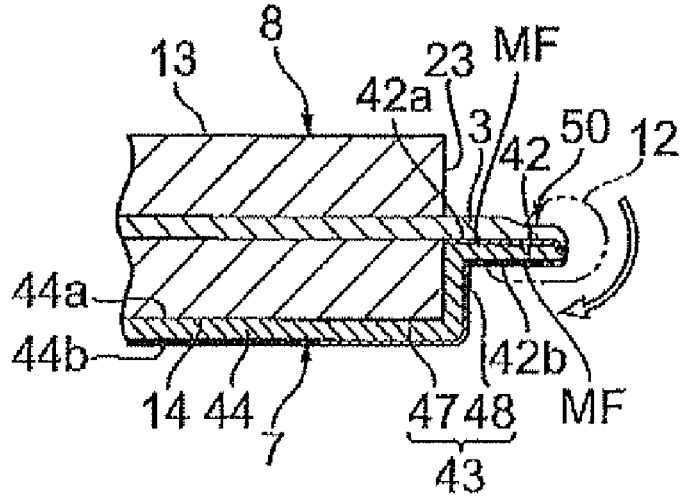

In the coil component 1 according to the present embodiment, the welding surfaces 32*a* and 42*a* have higher wettability than that of the rear surfaces 32*b* and 42*b* of the welding pieces 32 and 42. For example, if the rear surfaces 32*b* and 42*b* have wettability that is the same as or higher than that of the welding surfaces 32*a* and 42*a*, there is a possibility of the welding portions 11 and 12 being pulled towards the tear surfaces 32*b* and 42*b* sides, respectively. In this case, there is a possibility that the shapes of the welding portions 11 and 12 become not stable. More specifically, as illustrated in FIG. 10B, if a plating MF is formed not only on the welding surface 42*a* of the welding piece 42 but also on the entire surface of the rear surface 42*b*, the wettability of the rear surface 42*b* is equivalent to the wettability of the welding surface 42*a*. In this case, the welding portion 12 is pulled towards the rear surface 42*b* side. Meanwhile, in the coil component 1 according to the present embodiment, the welding surfaces 32*a* and 42*a* of the welding pieces 32 and 42 have higher wettability than that of the rear surfaces 32*b* and 42*b*. Accordingly, the welding portions 11 and 12 can form a stable shape without being pulled towards the rear surfaces 32*b* and 42*b* side. More specifically, as illustrated in FIG. 10A, the plating MF is formed only on the welding surface 42*a* of the welding piece 42, but not formed on the tip side of the rear surface 42*b*. Consequently, the wettability of the welding surface 42*a* becomes higher than the wettability of the rear surface 42*b*. Therefore, the welding portion 12 can maintain the stable shape without being pulled towards the rear surface 42*b* side. However, within the range of the welding portion 12 not being pulled, the plating MF may be formed on the base side of the rear surface 42*b*. Accordingly, allowing the plating to be formed somewhat on the rear surface makes it possible to facilitate the positioning work when plating.

In the coil component 1 according to the present embodiment, the main body portion 8 has the inclined surfaces 22 and 24 between the first side surface 16 that is the end thereof in the first direction D1 and the drawing surfaces 21 and 23, and the inclined surfaces 22 and 24 are inclined so as to be away from the welding portions 11 and 12 towards the first direction D1. With the foregoing structure, it makes it possible to prevent the heat produced when forming the welding portions 11 and 12 from transferring to the main body portion 8 via the inclined surfaces 22 and 24.

In the coil component 1 according to the present embodiment, the pair of lead wires 2 and 3 extends towards the outside of the main body portion 8 so as to spread wider from each other. With the foregoing structure, the drawing surfaces 21 and 23 where the pair of lead wires 2 and 3 is drawn out are disposed towards the corner portions of the main body portion 8. The drawing surfaces 21 and 23 are the surfaces disposed towards the coil 9 side from the first side surface 16 that is the end of the main body portion 8 in the first direction D1. Accordingly, when the lead wires 2 and 3 are drawn out near the center position of the main body portion 8, the drawing surfaces 21 and 23 are formed near the center position of the main body portion 8. When the drawing surfaces 21 and 23 are formed near the center position of the main body portion 8, there is, a possibility that the wall thicknesses near the drawing surfaces 21 and 23 with respect to the coil 9 become small. More specifically, as indicated by the dashed dotted lines in FIG. 3, if the drawing surface 23 is expanded to the center side, the wall thickness between the coil 9 near the drawing surface 23 and the drawing surface 23 becomes small as indicated by T1. In the coil component 1 according to the present embodiment, the fact that the drawing surfaces 21 and 23 are disposed close to the corner portions makes it possible to sufficiently secure the wall thicknesses with respect to the coil 9.

In the coil component 1 according to the present embodiment, the main body portion 8 has the outside dimension defined region OE that defines the outside dimension, and the welding portions 11 and 12 are disposed within the outside dimension defined region OE. Accordingly, when the coil component 1 is mounted on an external component, this makes it possible to prevent the welding portions 11 and 12 from interfering with other components. Furthermore, by performing the welding work such that the welding portions 11 and 12 are disposed between the drawing surfaces 21 and 23 and the first side surface 16, stable work can be performed with reduced plays of the lead wires 2 and 3.

In the coil component 1 according to the present embodiment, the welding portions 11 and 12 are separated from the drawing surfaces 21 and 23. This makes it possible to prevent the heat produced when forming the welding portions 11 and 12 from transferring to the main body portion 8 via the drawing surfaces 21 and 23.

In the method for manufacturing the coil component 1 according to the present embodiment, the lead wires 2 and 3 and the welding pieces 32 and 42 are pressed to each other and are welded together at the pressure applying portion 50 where the pressure is applied. For example, in the conventional coil component, as indicated in FIG. 90, there has been a possibility of the lead wire 3 and the welding piece 42 becoming apart, whereby the welding portion becomes separated. However, in the coil component 1 according to the present embodiment, the lead wires 2 and 3 and the welding pieces 32 and 42 are welded under a securely fixed condition. As a consequence, this surely prevents the lead wires 2 and 3 and the terminal fittings 6 and 7 from being separated after welding, thereby ensuring the connectivity between the lead wires 2 and 3 and the terminal fittings 6 and 7. A simple work of only pressing the lead wires 2 and 3 and the terminal fittings 6 and 7 allows the lead wires 2 and 3 and the terminal fittings 6 and 7 to be fixed. In the present embodiment, reciprocating the pressure applying tool PA2 in an up-and-down direction only once can fix the lead wires 2 and 3 to the terminal fittings 6 and 7. Accordingly, compared with when performing a swaging work of swaging parts of the terminal fittings 6 and 7 to the lead wires 2 and 3 (not possible by the movement of a tool in the up-and-down direction only) or with the work of winding the lead wires 2 and 3 to the terminal fittings 6 and 7, the foregoing pressure applying work can significantly simplify the movement of the work as well as simplifying the structure and the movement of the manufacturing apparatus. As a consequence, the work efficiency in the manufacturing can be enhanced and the reliability of the component can be improved.

The method for manufacturing the coil component 1 according to the present embodiment further include, under the condition of the lead wires 2 and 3 and the welding pieces 32 and 42 being pressed, the cutting step S6 to cut the lead wires 2 and 3. This allows the cutting work of the lead wires 2 and 3 to be performed reliably and easily.

In the method for manufacturing the coil component 1 according to the present embodiment, the pair of lead wires 2 and 3 is drawn out of the main body portion 8 and the pair of lead wires 2 and 3 is both drawn out towards the first direction D1. Accordingly, drawing out the pair of lead wires 2 and 3 in the same direction in the pressure applying step S5 allows the pressure to be applied to both of the lead wires 2 and 3 using a single pressure applying tool PA1 and a single pressure applying tool PA2 in a single action. Consequently, the work efficiency can be enhanced.

In the method for manufacturing the coil component 1 according to the present embodiment, the cut portions of the lead wires 2 and 3 cover the end surfaces of the welding pieces 32 and 42, respectively. Accordingly, the lead wires 2 and 3 and the welding pieces 32 and 42 can be fixed more firmly.

In the method for manufacturing the coil component 1 according to the present embodiment, in the terminal fitting preparing step S3, the lead frame LF formed with a plurality of terminal fittings 6 and 7 is prepared. This makes it possible to process a plurality of coil components 1 at a time, allowing the pressure applying step S5, the cutting step S6, and the welding step S1 to be performed all at once.

The present invention is not limited to the foregoing embodiment.

For example, while the inclined surfaces are formed between the drawing surfaces and the first side surface 16, faces perpendicular to the drawing surfaces and the first side surface 16 may be formed. Furthermore, while the first side surface 16 is formed as the end of the main body portion 8 in the first direction D1, the end may not need to be a surface. In other words, it may be in any shape, as long as it can define the outside dimension defined region of the main body portion 8. For example, the inclined surface 22 and the inclined surface 24 may be directly connected together to form a triangle. In this case, the apex of the triangle corresponds to the end of the main body portion 8 in the first direction D1.

Furthermore, the lead wires may be cut only by the cutting associated with the welding without performing the cutting step S6.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A coil component comprising:

a main body portion structured with green compact containing magnetic material;

a coil arranged inside the main body portion;

a pair of lead wires each drawn out from the coil to outside of the main body portion; and a terminal fitting to be connected to the lead wire at the outside of the main body portion, wherein the lead wire and the terminal fitting are welded to form a welding portion, the pair of lead wires is both drawn out towards a first direction that is orthogonal to an axis direction of the coil, the main body portion includes a drawing surface where the lead wire is drawn out towards the outside, and the drawing surface is disposed towards the coil side from an end of the main body portion in the first direction and perpendicularly intersects the lead wire.

2. The coil component according to claim 1, wherein the terminal fitting includes:

a base body piece extending along a main surface of the main body portion that intersects the axis direction and connected to the main body portion; and a welding piece extending along the lead wire and welded with the lead wire, the base body piece includes a bonding surface to be bonded with the main surface and a mounting surface to be mounted on an external component at a rear surface side of the bonding surface, and the welding piece includes a welding surface facing the lead wire.

3. The coil component according to claim 2, wherein the welding surface is higher in wettability for material constituting the lead wire than a rear surface of the welding surface of the welding piece.

4. The coil component according to claim 1, wherein the main body portion includes a inclined surface between the end in the first direction and the drawing surface, and the inclined surfaces are inclined so as to be away from the lead wire towards the first direction.

5. The coil component according to claim 1, wherein that the pair of lead wires extends towards outside of the main body portion so as to spread wider from each other.

6. The coil component according to claim 1, wherein the main body portion has an outside dimension defined region that defines an outside dimension, and the welding portion is disposed within the outside dimension defined region.

7. The coil component according to claim 1, wherein the welding portion is separated from the drawing surface.

8. A method for manufacturing a coil component including a main body portion arranged with a coil inside thereof, a lead wire drawn out from the coil towards outside of the main body portion, and a terminal fitting to be connected with the lead wire at the outside of the main body portion, the method comprising:

a step of preparing the main body portion arranged with the coil inside thereof and the lead wire drawn out;

a step of preparing the terminal fitting including a welding piece extending along the lead wire and welded with the lead wire;

a step of pressing the lead wire and the welding piece; and a step of welding pressed portions of the lead wire and the welding piece.

9. The method for manufacturing a coil component according to claim 8, wherein the main body portion is structured with green compact containing magnetic material.

10. The method for manufacturing a coil component according to claim 8, wherein the welding piece includes a welding surface facing the lead wire, and the welding surface is higher in wettability for material constituting the lead wire than a rear surface of the welding surface of the welding piece.

11. The method for manufacturing a coil component according to claim 8, further comprising a step of cutting at least the lead wire under a condition of pressing the lead wire and the welding piece.

12. The method for manufacturing a coil component according to claim 8, wherein a pair of such lead wires is drawn out of the main body portion, and the pair of lead wires is both drawn out towards a first direction that is orthogonal to an axis direction of the coil.

13. The method for manufacturing a coil component according to claim 11, wherein in the step of cutting the lead wire, a cut portion of the lead wire covers an end surface of the welding piece.

14. The method for manufacturing a coil component according to claim 8, wherein the main body portion includes a drawing surface where the lead wire is drawn out towards outside, the drawing surface is disposed towards the coil side from an end of the main body portion in a drawing direction of the lead wire, and a welding portion formed by welding the lead wire and the welding piece is disposed between the drawing surface and the end.

15. The method for manufacturing a coil component according to claim 8, wherein in the step of preparing the terminal fitting, a lead frame formed with a plurality of such terminal fittings is prepared.

* * * * *